United States Patent [19]

Cuschera

[11] 4,090,267

[45] May 23, 1978

[54] SELF CAULKING TOILET DRAIN

[76] Inventor: Casper Cuschera, 800 Durham Rd., Fremont, Calif. 94538

[21] Appl. No.: 783,319

[22] Filed: Mar. 31, 1977

[51] Int. Cl.[2] ..... E03C 1/26; E03C 11/00

[52] U.S. Cl. ..... 4/288; 4/252 R

[58] Field of Search ..... 4/288, 252 R, 145, 146, 4/191, 286; 277/177, 117, 119; 285/56, 57, 58, 59, 60

[56] References Cited

U.S. PATENT DOCUMENTS

| | | | |
|---|---|---|---|
| 3,579,670 | 5/1971 | Frank | 4/252 R |
| 3,668,718 | 6/1972 | Cuschara | 4/288 |
| 3,896,511 | 7/1975 | Cuschara | 4/288 |
| 3,952,340 | 4/1976 | Cuschara | 4/288 |

*Primary Examiner*—Henry K. Artis
*Attorney, Agent, or Firm*—Harris Zimmerman

[57] ABSTRACT

A drain for connecting a toilet to a discharge pipe includes a cylindrical drain body having a flange extending radially from the upper end thereof, and a plurality of bosses extending subjacently from the flange and joined to the exterior of the drain body. The bore of the drain body is tapered at the lower end, defining a lower opening through which the discharge pipe freely extends. A sealing gasket disposed within the bore about the discharge pipe is bevelled at the lower end to mate with the taper of the bore. The upper end of the sealing gasket is also tapered to mate with a similarly bevelled compression ring secured within the bore superjacent to the sealing gasket. The compression ring is provided with radially outwardly extending ears through which screws extend to be secured in threaded holes within the bosses of the drain body. The flange includes a plurality of holes therethrough for securing the drain body to the floor and for receiving the mounting lugs which extend downwardly from the toilet.

7 Claims, 6 Drawing Figures

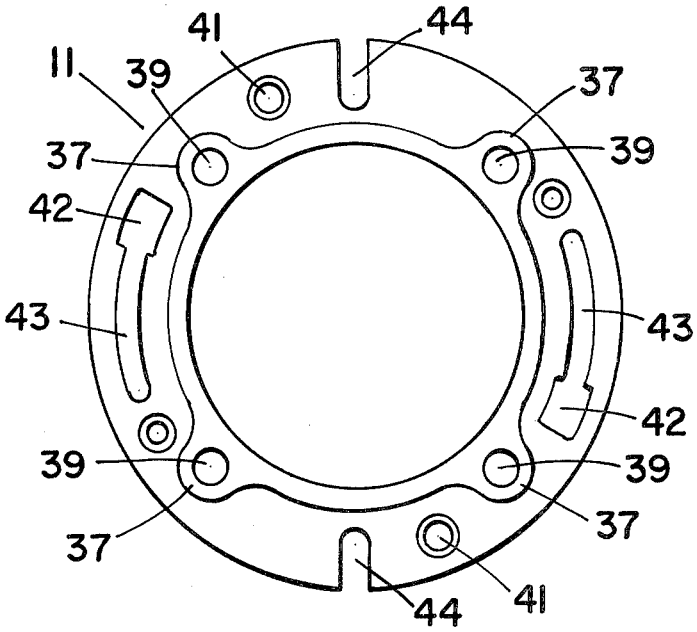
FIG_1
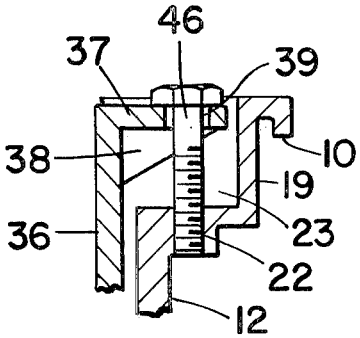
FIG_6
FIG_5
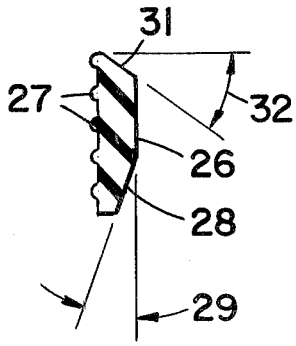
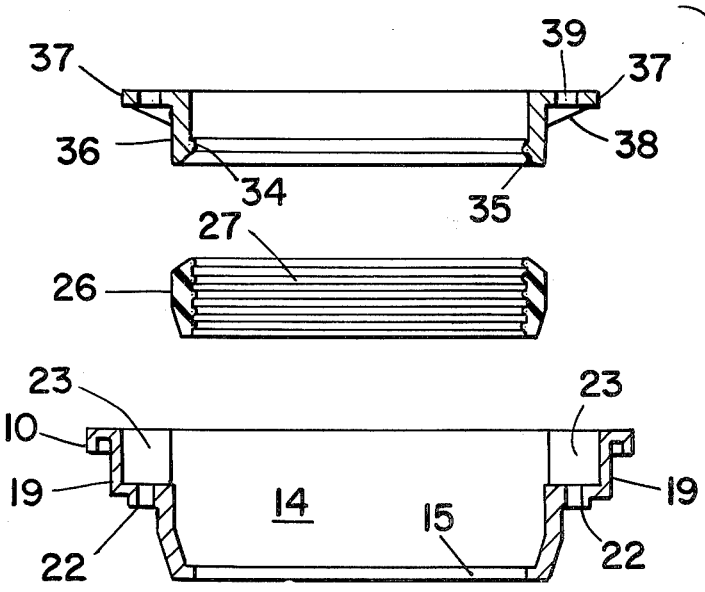
FIG_2
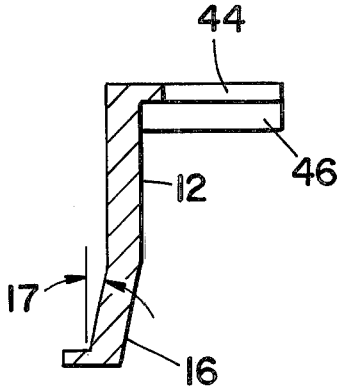
FIG_4
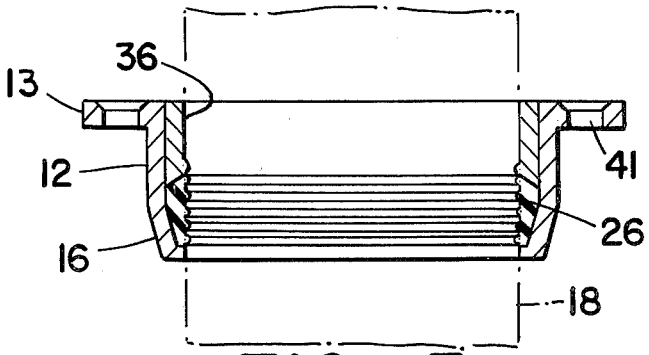
FIG_3

SELF CAULKING TOILET DRAIN

BACKGROUND OF THE INVENTION

The following U.S. Pat. Nos. are the most relevant prior art known to applicant:

3,579,670
3,896,511
3,952,340

The first of the enumerated patents discloses a toilet drain which provides a gasket for effecting a seal with a discharge pipe, and a pressure ring for compressing the gasket to form such a seal. In this patent, both the sealing gasket and the pressure ring are disposed subjacently and externally of the drain body itself. Screws extend from the drain body to the pressure ring to join the two elements together; it is significant to note that the screws must be threaded blindly into the pressure ring to effect assembly of the drain elements.

The remaining two patents, issued to Casper Cuschera, the present inventor, disclose self-sealing drain arrangements in which an annular sealing gasket is disposed within the drain body and about the discharge pipe. In one case the sealing gasket is compressed to form a seal by an externally threaded nut which engages internal threads in the bore of the drain body. In the other patent, the sealing gasket is compressed by a snap ring which engages an annular groove in the bore of the drain body.

It has been found that it is sometimes difficult to properly engage the externally threaded nut with the internal threads of the bore of the drain body. Furthermore, a special spanner tool is required to tighten the nut sufficiently to effect a leak-proof compression seal. The snap ring arrangement presents no difficulties insofar as installation is concerned. However, it has been found that the snap ring is difficult to remove, a step which is necessary to remove, reset, or replace the drain.

SUMMARY OF THE PRESENT INVENTION

The present invention generally comprises a self-sealing toilet drain which is easier to install or remove than any prior art arrangement. The drain includes a generally cylindrical body having a bore extending therethrough, the lower portion of the bore being tapered. A flange extends radially outwardly from the upper extremity of the drain body, and a plurality of bosses extend subjacently from the flange and are joined to the exterior of the drain body.

The waste discharge pipe extends upwardly into the bore of the drain body, and an annular gasket is disposed within the bore and about the discharge pipe. The sealing gasket is provided with a tapered lower circumferential surface which mates with the taper of the bore, and an upper bevelled edge. Impinging on the upper bevelled edge of the sealing gasket is the bevelled lower edge of an annular compression ring which is also disposed within the bore and about the discharge pipe.

The compression ring is provided with a plurality of radially outwardly extending ears, each ear having a hole extending normally therethrough. Each ear is aligned with one of the bosses in the drain body, and the lower portion of each boss is provided with a threaded hole extending parallel to the axis of the drain body. Screws or bolts extend through the ears of the compression ring and are received in the threaded holes of the bosses to pull the compression ring into an axially compressive relationship with the sealing gasket. The taper of the sealing gasket and the lower portion of the drain body transforms the axial compression into lateral expansion, thereby effecting a leak-proof seal between the sealing gasket, the drain body, and the waste discharge pipe.

The flange extending from the drain body is provided with a pair of laterally opposed lug holes which receive the lugs extending from the toilet. An annular slot extends from each lug hole to lock the lug in place and secure it against any axial movement. A pair of diametrically opposed, radially extending slots are also provided in the flange to secure toilets having bolt mountings rather than lug mountings. The flange also includes a plurality of countersunk screw holes which receive screws for securing the drain body to the floor which supports both the drain body and the toilet.

A BRIEF DESCRIPTION OF THE DRAWINGS

FIG. 1 is a plan view of the self-sealing toilet drain of the present invention.

FIG. 2 is an exploded view of the elements of the self-sealing toilet drain of the present invention.

FIG. 3 is a cross-sectional elevation of the toilet drain of the present invention, shown in an assembled disposition.

FIG. 4 is an enlarged cross-sectional elevation of a portion of the drain body of the present invention.

FIG. 5 is an enlarged cross-sectional elevation of a portion of the sealing gasket of the present invention.

FIG. 6 is an enlarged cross-sectional elevation showing the manner of assembling the compression ring to the drain body of the present invention.

DESCRIPTION OF THE PREFERRED EMBODIMENT

With reference to the accompanying figures, the self-sealing drain 11 of the present invention includes a generally cylindrical drain body 12. Extending radially outwardly from the upper end of the drain body 12 is a flange 13. A lip 10 extends downwardly from portions of the peripheral edge of the flange 13 for reinforcement purposes.

The drain body 12 includes a bore 14 extending axially therethrough. The lower portion 16 of the drain body is tapered inwardly, both externally and internally. As shown in FIG. 4, the lower extent of the bore 14 is tapered at an angle 17. The lower opening of the bore 15 is sufficiently wide to receive freely therethrough a waste discharge pipe 18.

Protruding outwardly from the upper periphery of the drain body 12, and extending downwardly from the flange 13, are four bosses 19. The bosses have a generally semi-cylindrical outer configuration, defining an interior cavity 23 having a similar shape. The lower wall of each boss is provided with a threaded hole 22 which extends parallel to the axis of the drain body. The bosses 19 are spaced equally about the circumference of the drain body.

The self-sealing toilet drain of the present invention is also provided with an annular, resilient sealing gasket 26. The sleeve-like gasket 26 is dimensioned to be received about the waste discharge pipe 18, and is provided with a plurality of annular ribs 27 which impinge on the pipe 18. The lower peripheral portion 28 of the sealing gasket is tapered inwardly at an angle 29, as shown in FIG. 5. The upper end 31 of the sealing gasket is bevelled at an angle 32.

It should be noted that the angle 29 of the taper 28 is substantially equal to the angle 17 of the taper in the bore of the drain body.

A generally cylindrical compression ring 36 is also provided, the exterior diameter of the compression ring being slightly smaller than the diameter of the upper portion of the drain body. The compression ring 36 is provided with a single annular rib 34 extending radially inwardly, with an outwardly flaring surface 35 extending from the rib 34 to the lower outer edge of the compression ring. It should be noted that the angle of the flared surface 35 is equal to the angle 32 of the bevelled portion 31 of the sealing gasket.

Extending radially outwardly from the upper end of the compression ring 36 are four ears 37. The ears 37 are equally spaced about the circumference of the compression ring, and a pair of reinforcing webs 38 extend obliquely from the exterior of the compression ring to the under side of each of the ears. The ears 37 are provided with a generally arcuate configuration, as shown in plan view in FIG. 1, the lateral dimensions of the ears being slightly less than the width and radial extent of the cavities 23. Each ear 37 is provided with a hole 39 extending therethrough parallel to the axis of the drain, the hole 39 being aligned with one of the threaded holes 22.

The flange 13 of the drain body 12 is provided with a pair of diametrically opposed lug holes 42. The lug holes 42 are generally rectangular, and are adapted to receive the mounting lugs which depend subjacently from the toilet, as is well known in the art. An annular slot 43 extends from each lug mounting hole 42 to retain the lug extending from the toilet against any axial movement. The flange 13 is also provided with a pair of diametrically opposed, radially extending slots 44 which are adapted to retain bolt mounting means extending upwardly to the toilet base, as is also commonly known in the art. Thus, the drain of the present invention is adapted to be used effectively with either of the common toilet mounting means known in the art.

The flange 13 also includes four countersunk screw holes 41, the holes 41 being spaced equally about the flange. The holes 41 are adapted to receive the screws which are threaded into the floor surrounding the discharge pipe to secure the drain 11 to the floor.

As shown in FIG. 4, a pair of reinforcing bars 46 extend outwardly from the drain body and subjacently from the flange 13. The reinforcing bars 46 straddle the slots 44 to strengthen that portion of the flange. The portion of the flange surrounding each mounting hole 41 is also reinforced in a similar manner.

The manner of installing and assembling the toilet drain of the present invention will next be described. First, the drain body 12 is placed over the waste discharge pipe 18, and is secured to the floor by means of the holes 41 in the flange 13. Next, the sealing gasket 26 is disposed about the discharge pipe 18, with the tapered end 28 secured in the lower tapered portion of the bore of the drain body. The compression ring 36 is then installed in the drain body, secured about the waste discharge pipe 18 with the ears 37 disposed in the cavities 23 of the drain body. The flared surface 35 of the compression ring impinges on the bevelled surface 31 of the sealing gasket.

As shown in FIG. 6, screws 46 are inserted through the holes 39 in the ears 37, and are threaded into the holes 22 of the bosses 19. As the screws 46 are tightened, the compression ring 36 is caused to axially compress the sealing gasket 26. Due to the action of the flared surface 35 acting on the bevelled surface 31, and the taper 28 of the gasket within the tapered bore, the axial compression of the sealing gasket is transformed into lateral expansion. This lateral expansion causes the sealing gasket to impinge on the waste discharge pipe and on the interior bore 14 in a sealing fashion. The drain 11 is thus joined to the waste discharge pipe 18 in a leak-proof manner. The toilet is then placed over the drain 11, and secured thereto by means of the lug mounting holes 42 or the bolt mounting slots 44. The installation is then complete.

It may be appreciated that the design of the drain of the present invention permits easy, efficient installation. All of the parts of the drain nest within the drain body itself, and cannot be lost underneath the floor. Furthermore, there is no blind threading of bolts or screws, as is common in prior art drains.

It should also be noted that the drain of the present invention may be disassembled and removed as quickly as it is assembled and installed. Thus, the repair, replacement, or resetting of the drain is made quite easy and simple. No special tools are required either for installation or removal.

I claim:

1. A toilet drain comprising a drain body having a bore extending therethrough for receiving a waste discharge pipe; a resilient sealing gasket secured within said bore and about said waste discharge pipe; a compression ring disposed in said bore and about said waste discharge pipe, said compression ring impinging on said sealing gasket, a plurality of ears extending outwardly from said compression ring; a plurality of hollow bosses extending outwardly from said drain body, each adapted to receive one of said ears therein, screw means extending from said ears to said bosses to compress said sealing gasket in a direction parallel to the axis of said drain body; and means for converting said compression of said gasket to lateral expansion to effect a seal between said drain body and said waste discharge pipe.

2. The drain of claim 1, wherein said last mentioned means includes a taper in the lower end of said bore and a similar taper in the lower outer surface of said sealing gasket.

3. The drain of claim 1, wherein the upper end of said sealing gasket is bevelled, and the lower edge of said compression ring is flared outwardly to mate with said bevel.

4. The drain of claim 1, further including a flange extending radially outwardly from the upper end of said drain body, said flange including means for securing said drain body to a floor, and means for securing said drain body to a toilet.

5. The drain of claim 1, wherein said bosses each comprise a generally semi-cylindrical member protruding from the upper end of said drain body and defining a generally semi-cylindrical hollow cavity therein.

6. The drain of claim 5, wherein said ears each are provided with a generally arcuate configuration having lateral and radial dimensions slightly less than said hollow cavity of said boss.

7. The drain of claim 6, wherein each of said bosses includes a threaded hole in the bottom thereof, and each of said ears includes a screw hole aligned with said threaded hole of a respective boss.

* * * * *